US009803962B2

(12) United States Patent
Hahn

(10) Patent No.: US 9,803,962 B2
(45) Date of Patent: Oct. 31, 2017

(54) BROADHEAD RETAINING CLIP

(71) Applicant: Bear Archery, Inc., Evansville, IN (US)

(72) Inventor: David Eugene Hahn, Elberfeld, IN (US)

(73) Assignee: Bear Archery, Inc., Evansville, IN (US)

( * ) Notice: Subject to any disclaimer, the term of this patent is extended or adjusted under 35 U.S.C. 154(b) by 0 days.

(21) Appl. No.: 15/255,362

(22) Filed: Sep. 2, 2016

(65) Prior Publication Data

US 2017/0122712 A1 May 4, 2017

Related U.S. Application Data

(60) Provisional application No. 62/248,628, filed on Oct. 30, 2015.

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS

| | | | | |
|---|---|---|---|---|
| 2,859,970 | A | 11/1958 | Doonan | |
| 5,102,147 | A | 4/1992 | Szeluga | |
| 5,112,063 | A | 5/1992 | Puckett | |
| 5,178,398 | A | 1/1993 | Eddy | |
| 5,803,844 | A | 9/1998 | Anderson | |
| 5,803,845 | A | 9/1998 | Anderson | |
| 6,015,357 | A | 1/2000 | Rizza | |
| 6,200,237 | B1 | 3/2001 | Barrie | |
| 6,217,467 | B1 | 4/2001 | Maleski | |
| 6,517,454 | B2 | 2/2003 | Barrie et al. | |
| 8,043,177 | B2 | 10/2011 | Flanagan | |
| 8,147,361 | B1 | 4/2012 | Weaver | |
| 8,192,310 | B2 | 6/2012 | Harris et al. | |
| 8,210,970 | B1 | 7/2012 | Sanford | |
| RE44,144 | E | 4/2013 | Barrie et al. | |
| 8,758,176 | B2 | 6/2014 | Pedersen | |
| 8,911,311 | B1 | 12/2014 | Mizek et al. | |
| 9,052,170 | B1 | 6/2015 | Campell et al. | |
| 9,228,813 | B1 * | 1/2016 | Pedersen | F42B 6/08 |
| 9,267,773 | B2 | 2/2016 | Mizek | |
| 2015/0168112 | A1 | 6/2015 | Hollars | |

* cited by examiner

*Primary Examiner* — John Ricci
(74) *Attorney, Agent, or Firm* — Woodard, Emhardt, Moriarty, McNett & Henry, LLP; Charles Meyer

(57) ABSTRACT

Various embodiments of the present disclosure include a mechanical broadhead for use with an archery bow and arrow. In certain arrangements, a broadhead is provided with a retaining clip that maintains the cutting blades in a retracted or closed position during flight of the arrow. Upon target contact, the blades expand outwardly from the closed position.

18 Claims, 10 Drawing Sheets

BROADHEAD RETAINING CLIP

This application claims the benefit of U.S. provisional application Ser. No. 62/248,628 filed Oct. 30, 2015, which is incorporated herein by reference.

FIELD OF ENDEAVOR

This disclosure relates broadly to an expandable broadhead for arrows and more particularly to a broadhead having a mechanism to retain the blades in a closed position prior to the blades being outwardly extended upon impact with a target.

BACKGROUND

In archery, a fired arrow is equipped with a point or head that engages a target. In bow hunting, a broadhead type of arrowhead may be used to increase damage to or bleeding of the target and otherwise facilitate capture of the target. Some broadheads are fired in a closed, aerodynamic position, and, upon impact with a target, are mechanically activated to expand and provide a broader cutting diameter. Preferably, the blades are maintained in the closed position during storage and during use and flight prior to impact. Many prior methods of maintaining the blades in a closed position use a circular or ring-shaped element, such as an o-ring, to hold the blades. An o-ring or similar ring-shaped element is typically mounted to the broadhead blades by translational movement along the axis of the broadhead and arrow shaft.

SUMMARY

Various embodiments of the present disclosure include a mechanical broadhead for use with an archery bow and arrow. In certain arrangements, a broadhead is provided that maintains the cutting blades in a retracted or closed position during flight of the arrow. Upon target contact, the blades expand outwardly from the closed position. In certain embodiments, a retaining clip is used which can be rotated to engage and retain the blades in a closed position prior to and during flight.

In certain embodiments, the broadhead includes a body adapted to attach to an arrow shaft and defining a shaft portion. A hub is slidably mounted on the shaft portion. One or more cutting blades are pivotally attached to the hub. A retaining clip maintains the blades in a closed position. Optionally, the blades abut a rearward shelf on the body which assists to maintain the blades in a closed position prior to impact. Upon impact, the target surface impacts the leading edges of the blade and hub assembly. The initial impact may break or dislodge the retaining clip. As the broadhead continues to travel forward, the hub and blade assembly moves rearward relative to the shaft portion. The blades are balanced and synchronized to slide along camming surfaces so that the blades rotate outward to a deployed position.

In certain further embodiments, a broadhead arrowhead includes a broadhead body adapted to attach to an arrow shaft and defining a longitudinal axis. A plurality of blades are pivotally mounted on the broadhead body, each blade operable between a closed position and an open position, each blade having a sharpened outward cutting edge. A retaining clip is arranged on the broadhead body, the retaining clip having a body and a plurality of lateral arms each defining a blade slot, with a lateral arm extending across the cutting edge of each blade to retain the blade in the blade slot. The broadhead is arranged so that upon an initial impact, each blade rotates and is no longer retained by the retaining clip.

In selected embodiments, a broadhead body is adapted to attach to an arrow shaft. The broadhead body has a forward end and a rearward end adapted to be mounted to an arrow, and defining a longitudinal axis. A plurality of blades are pivotally mounted on the broadhead body and operable between a closed position and an open position, each blade including a sharpened outward cutting edge. A retaining clip is arranged adjacent the forward or the rearward ends of the blades in the closed position. The retaining clip is arranged to be rotatable around the longitudinal axis and in a plane perpendicular to the axis to engage the plurality of blades. The retaining clip has a body and a plurality of lateral arms, with each lateral arm engaging a respective blade.

In certain additional embodiments, a broadhead body is adapted to attach to an arrow shaft. The broadhead body has a forward end and a rearward end adapted to be mounted to an arrow, and defining a longitudinal axis. A plurality of blades are pivotally mounted on the broadhead body and operable between a closed position and an open position. A retaining clip is arranged adjacent the forward ends of the blades in the closed position. The retaining clip is arranged to be rotatable around the longitudinal axis and in a plane perpendicular to the axis to engage the plurality of blades. The retaining clip has a body and a plurality of lateral arms, with each lateral arm extending around a blade tip when the retaining clip engages a respective blade.

An exemplary method of securing a broadhead arrowhead in a closed position includes: providing a broadhead body adapted to attach to an arrow shaft, the broadhead body defining a longitudinal axis and having a plurality of blades pivotally mounted on the broadhead body and operable between a closed position and an open position; placing the blades in the closed position; placing a retaining clip over a portion of the broadhead body where the retaining clip has a plurality of lateral arms, with each lateral arm defining a blade slot; rotating the retaining clip around the longitudinal axis so that a portion of each blade is received in a respective blade slot; and retaining a portion of each blade in a respective blade slot. The method optionally may include applying force to the retaining clip to place the blades in compression while the blades are retained in the retaining clip. In certain embodiments, the method includes mounting a pointed tip to the broadhead body after placing the retaining clip over a portion of the broadhead body. The method may include tightening the pointed tip to the broadhead body to apply a rearward force against the retaining clip to place the blades in compression.

Other objects and attendant advantages will be readily appreciated as the same become better understood by references to the following detailed description when considered in connection with the accompanying drawings.

DETAILED DESCRIPTION OF EMBODIMENTS

Figure 1:
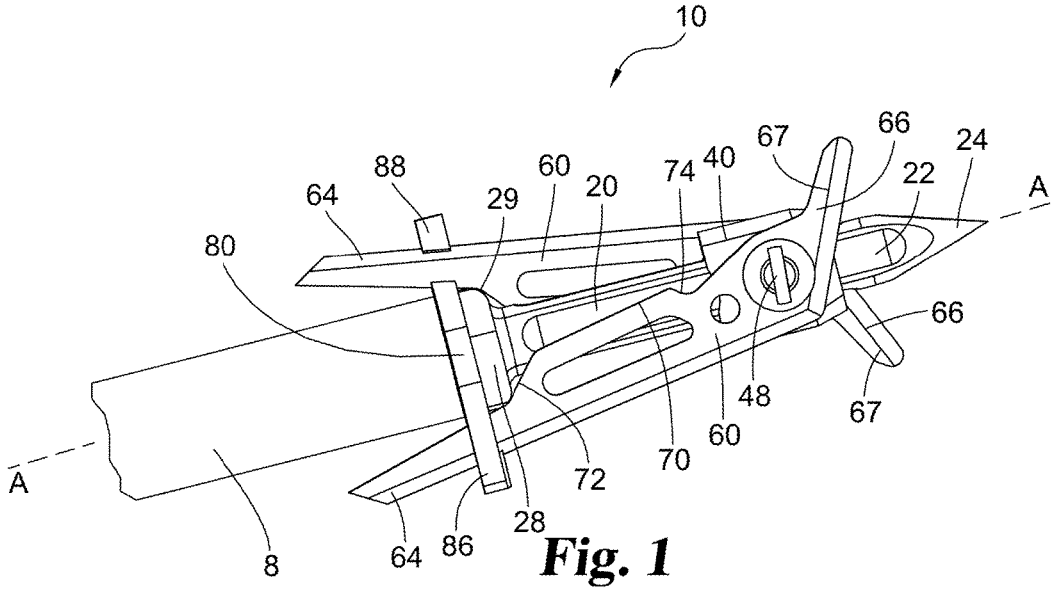
FIG. 1 is a side perspective view of a mechanical broadhead in a closed position according to an embodiment of the disclosure.

For the purposes of promoting an understanding of the principles of the disclosure, reference will now be made to the embodiments illustrated and specific language will be used to describe the same. It will nevertheless be understood that no limitation of the scope of the disclosure is thereby intended, such alterations, modifications, and further applications of the principles being contemplated as would normally occur to one skilled in the art to which the invention relates Various embodiments of the present disclosure include a mechanical broadhead for use with an archery bow and arrow that maintains the cutting blades in a retracted or closed position during a flight of the arrow. Arrows with mechanical broadheads can be used by archers with compound bows, recurve bows or crossbows as desired. A retaining clip is used which can be rotated to engage and retain the blades in a closed position. In an example embodiment, a hub and blade assembly is slidably mounted on the shaft portion of a broadhead body. One or more blades are pivotally attached to the hub and are operable between a closed position and an open position. In the illustrated embodiments, the retaining clip has a body and one or more lateral arms, which each engage and retain a blade in the closed position prior to launch and during flight of the arrow. Upon target impact, the blades expand from the closed position to an open position.

The illustrated broadhead with a sliding hub is an example, non-limiting embodiment. Aspects of the present disclosure such as the rotatable retaining clip can be used with various types of mechanical broadheads. For example this can include mechanical broadheads with blades which are pivotally mounted at their forward ends and where the rearward ends are forced to move outward to a deployed position upon impact. In alternate arrangements, the blades are pivotally mounted at a rearward end and a forward end rotates outward and rearward to a deployed position upon impact. In still further arrangements, the blades may be slidably and pivotally movable from a retracted position to a deployed position upon impact. Versions of the rotatable retaining clip can be used with broadheads with two, three, four or more blades.

Directional references herein are for ease of explanation and are not intended to be limiting.

FIGS. 1-4 show views of an embodiment of an example broadhead generally designated 10. The broadhead 10 is adapted for mounting to an open end of a hollow arrow shaft 8. The broadhead 10 includes a body 20. Body 20 has a forward end with a pointed tip 24, and a rearward end configured to be connected to an arrow shaft. For example, the rearward end may include threads configured for pairing with threads inside of the arrow shaft. In other forms, broadhead 10 may be mounted to an arrow shaft in other ways, such as with mechanical fasteners, adhesives, resins, mounting on a ferrule or arrow shaft insert, or using other attachment techniques.

The forward end of broadhead body 20 includes tip 24. The tip 24 may be made integrally with or separate and attached to a forward portion of a central shaft 22. Typically, the pointed tip 24 is tapered rearwardly and outwardly. The tip base may extend outward from or may merge with the profile of shaft 22. Shaft 22 may be formed with a circular or non-circular cross-section, for example in the illustrated embodiment portions of shaft 22 have a substantially square cross-section.

In certain optional embodiments, a rearward portion of shaft 22 transitions into a shelf or ledge 28, extending radially outward from at least portions of the sides of shaft 22. Certain edges of shelf or ledge 28 may form camming surfaces 29. A portion of body 20 extends rearward from shelf 28 to the rearward end. Body 20 can be integrally made as a single piece. Alternately, body 20 may be assembled from one or more pieces secured together.

In the illustrated embodiment, hub 40 is slidably mounted on shaft 22 along an axis A, typically between tip 24 and shelf 28. Hub 40 is operable to translate forward or rearward relative to shaft 22. Hub 40 defines an interior passage with a cross-section sized and shaped to approximately match the cross-section of shaft 22 and which inhibits rotation of hub 40 with respect to shaft 22. In certain embodiments, lock screws 48 extend through the blades 60 and into hub 40. Optionally, inward ends of the lock screws 48 are advanced inward during assembly and received in elongated axial grooves or slots on sides of shaft 22. Lock screws 48 may be selectively advanced into the grooves a sufficient distance to prevent hub 40 from sliding off of shaft 22, yet allow hub 40 to freely translate along shaft 22 within a range defined by the axial length of the grooves.

Optionally, the lock screw inward ends are received within the volume of respective grooves, but the inward ends do not need to contact the bottom or sides of the groove. In certain embodiments, the inward ends are rounded, for example formed in a hemispherical shape. Optionally, the inward end may be made with a slide facilitating material or a material to facilitate sliding motion may be placed between the pin inward end and the respective groove, for example a Delrin® or Teflon® material.

One or more cutting blades 60 are pivotally attached to the exterior of hub 40. As illustrated, the flat sides or faces of each blade define a plane which is parallel to yet offset or angled so the plane does not intersect the longitudinal axis A of shaft 22. In the illustrated embodiment, a pair of blades 60 are pivotally mounted to hub 40. As illustrated, the planes of the two blades are parallel to each other on opposing sides of the longitudinal axis of shaft 22.

A lock screw 48 extends through a pivot axle opening 62 defined in each blade so that the lock screw acts as an axle for the blade. The blades are secured to the exterior of hub 40 via the lock screws while remaining operable to pivot. In the illustrated embodiment, the lock screws 48 have a shaft with a smooth cylindrical axle portion with a thickness approximately matching the thickness of a blade, with a portion extending beyond the blade. A portion of the screw shaft between the axle portion and the inward end is threaded to engage hub 40. Preferably, each lock screw 48 forms a locking engagement with hub 40 which prevents unintended removal of the lock screw from the hub. Alternately, other connection methods or fasteners can be used to pivotally mount the blades to a hub.

Each blade 60 is roughly triangular in shape, and includes an outward cutting edge 64. Typically the outward cutting edge 64 is the primary cutting edge and is sharpened to cut a target such as an animal. Each blade 60 further includes an inward edge. The inward edge includes a central camming portion 70. Rearward of portion 70 is a retention notch 72. Forward of portion 70 is a locking notch 74. Each blade further includes a leading forward edge 66 which extends to a leading tip or corner 67. As illustrated from the perspective of FIG. 1, forward edge 66 is angled to substantially diverge and be non-parallel relative to the longitudinal axis A of broadhead body 20 from a rearward corner which forms an apex with cutting edge 64. From the apex with cutting edge 64, forward edge 66 is angled to extend across and forward to the corner or apex of tip 67.

Each blade 60 defines an axle hole or pivot hole 62 around which the blade may pivot. A forward blade portion is arranged forward of the pivot hole and a rearward portion is arranged rearward of the pivot hole, with an apex or corner adjacent the pivot hole. In the illustrated embodiment, the forward blade portion including forward edge 66 is arranged at an angle with respect to the rearward portion with cutting edge 64 which forms a bell crank arrangement around pivot hole 61 such that pivotal movement or retention of the forward blade portion can be used to control the location of the rearward blade portion, and vice-versa.

Figure 2:
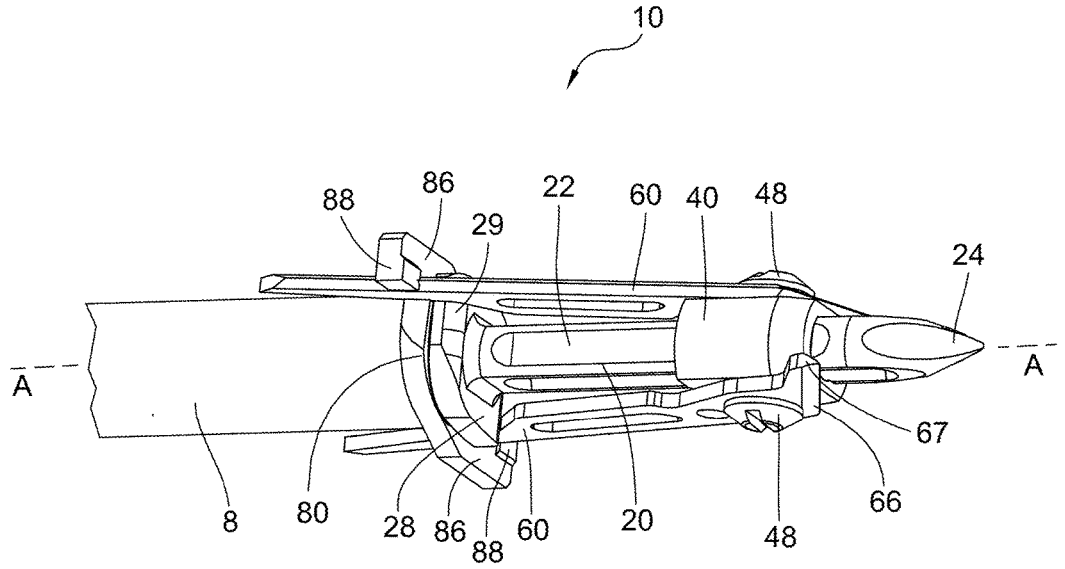
FIG. 2 is alternate side perspective view of the broadhead of FIG. 1
Figure 3:
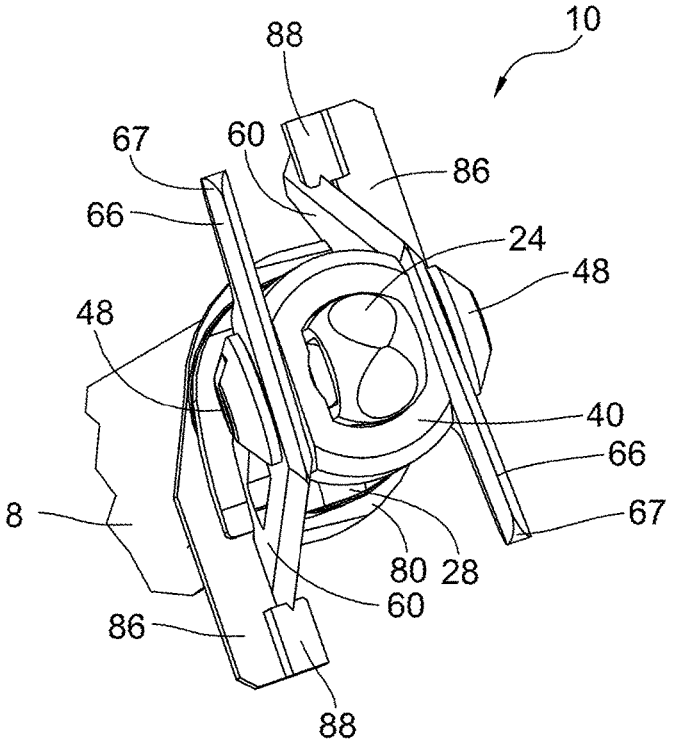
FIG. 3 is a perspective front view of the broadhead of FIG. 1.
Figure 4:
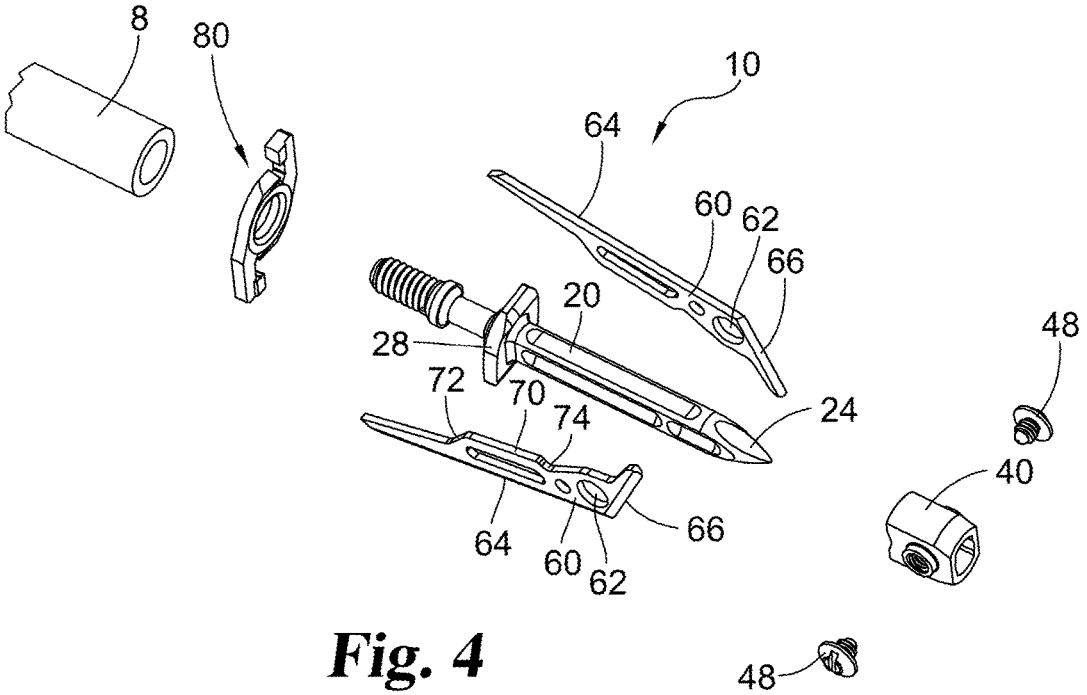
FIG. 4 is an exploded view of the broadhead of FIG. 1.

FIGS. 1-3 specifically illustrate broadhead 10 in a closed configuration. In the closed position, hub 40 is at its forwardmost position, adjacent to tip 24. In the closed position, the length of blades 60 is close to parallel to shaft 22. If present, the retention notch 72 of each blade abuts a forward face of shelf 28.

Figure 5:
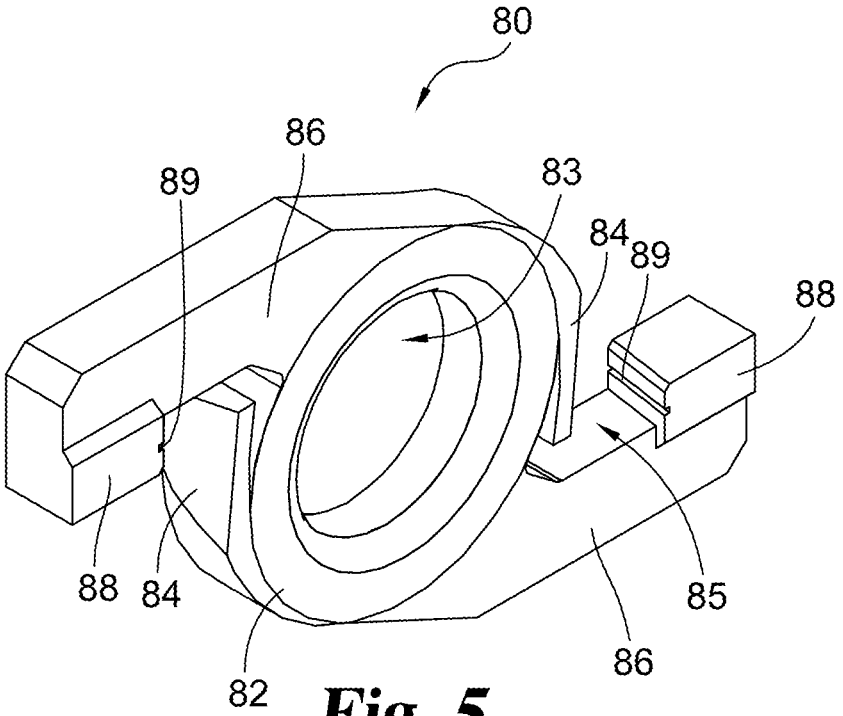
FIG. 5 is a perspective view of a retaining clip usable with the broadhead of FIG. 1.
Figure 6:
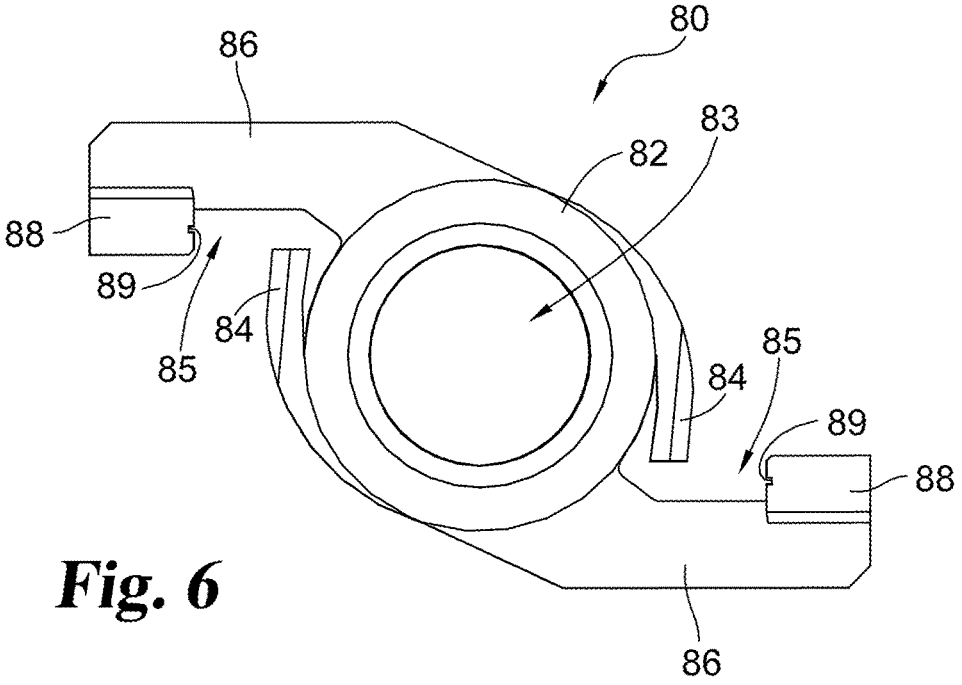
FIG. 6 is a front view of the retaining clip of FIG. 4.

In certain embodiments, broadhead 10 includes a retaining clip 80, for example arranged adjacent the rearward portions of blades 60 in the closed position. Retaining clip 80 is illustrated in detail in FIGS. 5 & 6. Retaining clip 80 includes a body or base portion 82 which defines an interior passage 83. Interior passage 83 allows retaining clip 80 to rotate with respect to the broadhead body and blades. Interior passage 83 may have a cross-section sized and shaped to surround a corresponding portion of arrow shaft 8 or alternately a portion of the broadhead body. Typically passage 83 has a circular cross-section arranged around a corresponding circular portion of the broadhead or arrow shaft. In some embodiments, base portion 82 is layered between the forward face of arrow shaft 8 and a rearward face of shelf 28.

Retaining clip 80 includes lateral arms 86 which extend from body 82 alongside a blade planar face and then across the cutting edge of each blade 60. The lateral arms may be parallel to yet offset from a geometric radius of the base portion. Typically the lateral arm extends along the outer blade face on a side opposite the parallel plane which contains the broadhead central axis A. Alternately, a retaining clip may have less arms than the number of blades, for example if the blades are mechanically synchronized such that retaining one blade will hold all of the blades closed.

Each lateral arm 86 defines an outer or distal end portion 88. Body 82 along with each lateral arm 86 and end portion 88 defines a blade slot 85 for receiving and retaining a portion of each blade 60 in the closed position, typically a rearward portion of the blade. The slot may define a lateral entrance opening through which the blade is introduced by rotating the clip in a plane perpendicular to the longitudinal axis of the broadhead body to introduce the blade into the blade slot. When engaged, end portion 88 extends across the cutting edge, forming a somewhat C-shaped blade slot. Optionally, an edge of end portion 88 may have a sloped aspect complimentary to a slope of the cutting edge 64 so that when blade 64 is urged laterally into blade slot 85, one or both sloped portions assist to urge blade 60 to pivot slightly inward and into slot 85. Further optionally, end portion 88 may define a notch 89 to engage the cutting edge, to assist in holding the cutting edge in the desired position and to assist in holding blade 60 in the desired alignment.

In certain embodiments, all or portions of the retaining clip such as the body 82, lateral arms 86 and/or end portions 88 may be designed to break-away upon impact, to allow blades 60 to deploy to an open position. The material of arms 86 may accordingly be breakable or frangible when blades 60 are expanded under the force of impact. In some embodiments, retaining clip 80 may define break-away notches, such as one or more grooves, notches or areas which are weakened or have a thinner cross-section in the body 82, in each lateral arm 86 and/or adjacent to each end portion 88 to facilitate a break-away action of end portion 88 or lateral arm 86 upon impact of the broadhead.

Optionally, retaining clip 80 may include a spring portion 84 adjacent the entrance to each blade slot 85, for example adjacent the inner edge of the blade. Each spring portion 84 may be formed from a cantilevered lever portion which can be temporarily deflected toward the body 82 as the blade enters blade slot 85, yet which rebounds partially alongside the blade side face once the blade has cleared the end of spring portion 84. Optionally, the outer surface of spring portion 84 approaching the blade slot includes an inward slanted or sloped aspect so that when blade 64 is urged laterally into blade slot 85, the inner edge of the blade can pivot slightly inward and correspondingly urges spring portion 84 slightly inward to allow blade 60 into slot 85. Once the width of blade 60 is within slot 85, an end face of spring portion 84 then partially abuts a side face of the blade, assisting to retain the blade in the blade slot. In certain embodiments, a portion of the inner face of blade slot 85, namely the portion which engages the blade inner edge diverges toward spring portion 84, urging the inward edge of blade 60 towards the face of spring portion 84 and/or towards end portion 88, applying a slight clamping force on the blade between the inner face of the slot, an end face of spring portion 84 and end portion 88.

Retaining clip 80 engages blades 60 in the closed position of broadhead 10 to inhibit rotation of the blades from the closed position to the open position prior to launch and during flight. In the closed arrangement, retaining clip 80 may apply a neutral retaining force or an inward biasing force to the blade ends to retain the blades 60 in the closed position.

In further alternate embodiments, the lateral arms of the retaining clip may be slightly flexible, with a lip or retaining flange formed adjacent the outer side of the entrance to each blade slot. As the blade is rotationally introduced into the blade slot, the lateral arms slightly flex sideways and/or with the end portion bent slight outward to accommodate the blade edge. The arm and end portion then rebound to extend across the cutting edge of the blade, placing the lip or flange past the cutting edge and alongside the blade side opposite the arm, thus assisting to retain the blade in the blade slot. Curved portions, sloped areas or angles can be formed on the retaining clip body, lateral arms, end portions and/or spring portions to assist in urging or wedging the respective portions to move sufficiently to allow clearance as the retaining clip is rotated to engage the blades with the blade slots.

Figure 7:
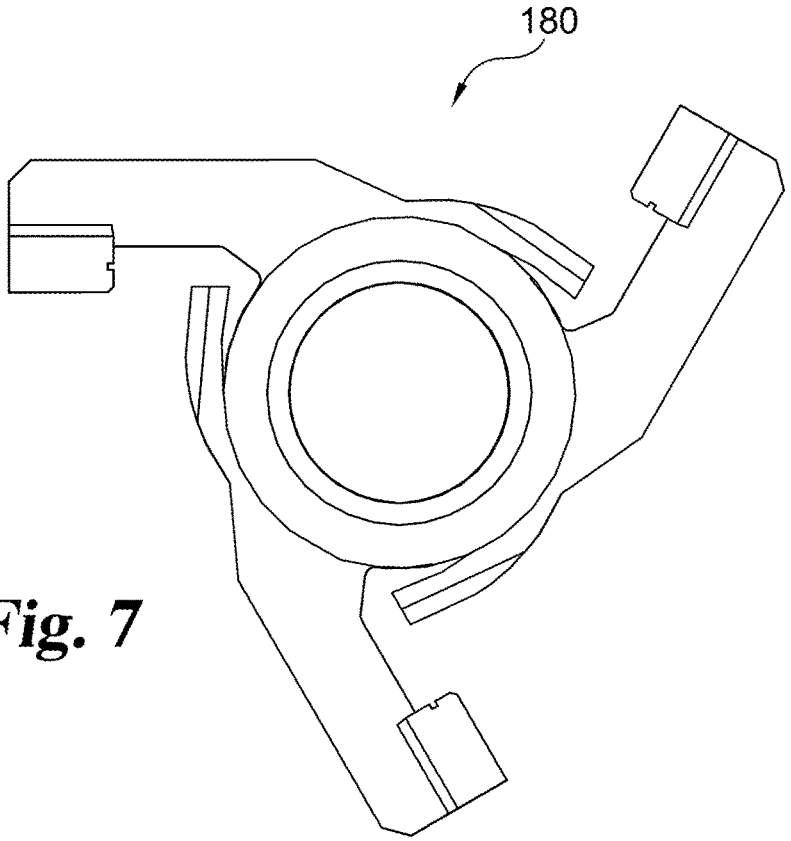
FIG. 7 is a front view of an alternate embodiment of a retaining clip usable with a broadhead with three blades.

Illustrated in FIG. 7 is an alternate embodiment of a retaining clip 180. Retaining clip 180 is substantially similar in structure and function to retaining clip 80. Retaining clip 180 has three lateral arms and is designed for use with a three bladed broadhead.

Figure 8:
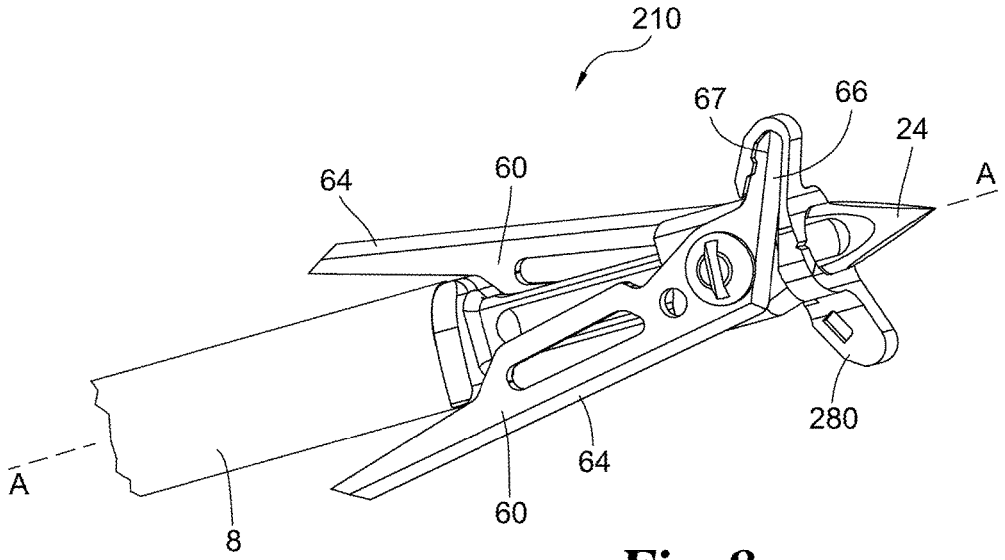
FIG. 8 is a side perspective view of a mechanical broadhead in a closed position according to an alternate embodiment of the disclosure.

FIG. 8 shows an alternate embodiment of a broadhead generally designated 210. Except as discussed herein, the mounting, structure and function of the broadhead body and blades in broadhead 210 is the same as or comparable to broadhead 10. Broadhead 210 includes a body with a pointed tip 24, and a rearward end configured to be connected to an arrow shaft. In the illustrated version, a pair of blades 60 are pivotally mounted to the broadhead, for example via a hub. As in broadhead 10, each blade 60 is roughly triangular in shape, and includes an outward cutting edge 64 plus the inward edge. Each blade further includes a leading forward edge 66 which extends to a leading tip or corner 67.

In certain embodiments, a retaining clip 280 is arranged to engage forward portions of the blades. For example it can be placed forward of the hub and blades. Retaining clip 280 is shown in detail in FIG. 9. Retaining clip 280 includes a slider body or base portion 282 which defines an interior passage 283 with a cross-section sized and shaped to encircle and approximately match the cross-section of the tip and forward end of the shaft portion of broadhead 210. The cross-section of passage 283 allows rotation of retaining clip 280 with respect to the broadhead, around the broadhead and arrow's longitudinal axis A. The rearward surface of slider body 282 may abut the forward surface of the hub. Optionally, break-away notches 284 may be defined in base portion 282 and/or adjacent to each lateral arm 286 to facilitate a break-away action of all or portions of the clip upon impact of the broadhead.

Retaining clip 280 includes lateral arms 286 which extend laterally from body 282 in front of each blade 60. Each lateral arm 286 defines a forward facing impact edge or surface. The forward facing impact edge may be a flat surface or may be tapered forward to form a sharpened cutting edge. Lateral arms 286 each define a blade slot 285 configured to receive the portion of a respective blade 60. The blade slot 285 may be angled in an outward and forward direction from body 282 to match the profile of blade edge 66 and tip 67. The rearward face of the forward portion of each impact arm 286 defines a rearward facing surface with a length and width sloped at an angle which covers and abuts a blade forward edge 66 when the broadhead is in the closed position and in the clip. The rearward face of the forward portion of the lateral arm may optionally define a slot or groove which receives forward edge 66 in a nesting arrangement.

Each blade slot 285 is defined by the rearward face of the forward portion of the lateral arm, an inner side wall extending rearward and substantially parallel to a face of the blade, and the inner face of an outer end 287. In the illustrated embodiment, outer ends 287 are each curved rearward to receive and partially encircle the apex formed by blade tip or corner 67 and to then slightly extend rearward and inward along an inward edge portion. The rearward face of the outer ends 287 may also optionally define a slot or groove which receives the blade tip 67 in a nesting arrangement.

Optionally a retention tab 288 is formed adjacent the lateral entrance to the blade slot, with the retention tab 288 positioned to be on the opposite side of the blade width from the inner wall when the blade is in position in the clip. In the illustrated embodiment, retention tab 288 is located along the rearward, outer edge of blade slot 285 and projects forward. The retention tab 288 and inner wall are spaced apart by a gap sized to receive the width of the blade.

Retaining clip 280 engages blades 60 in the closed position of broadhead 210 to inhibit rotation of the blades prior to launch and during flight. The retaining clip may be rotated so that that slots 285 receive and engage the blade forward portions to cover the forward edges and encircle the tips in a rotational action relative to the broadhead body axis A. The retaining clip may be engaged with a snap-on movement during rotation, wherein blade edges 66 enter the blade slots 285 sufficiently to allow retention tabs 288 to slide past the blade width. The retention tab may slightly flex outward during rotational movement, and may then rebound to partially abut a blade face, thereby capturing the blade width between the retention tab and the inner wall. In the closed arrangement, retaining clip may apply a neutral retaining force or an inward biasing force to blade tips 67 to retain the blades 60 in the closed position.

Figure 10:
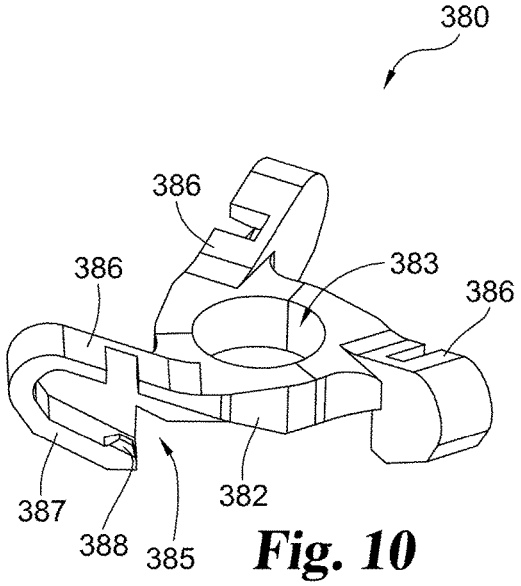
FIG. 10 is a perspective view of an alternate embodiment of a retaining clip usable with a broadhead with three blades.

A variation of retaining clip 280 configured for a three bladed broadhead is shown in detail in FIG. 10. Retaining clip 380 includes a body or base portion 382 which defines an interior passage 383 with a cross-section sized and shaped to encircle and approximately match the cross-section of the tip and forward end of shaft of a broadhead. The cross-section of passage 383 allows rotation of retaining clip 380 with respect to the broadhead, around the broadhead and arrow's longitudinal axis. The rearward surface of retaining clip body 382 may abut the forward surface of the hub. Optionally, break-away notches may be defined in base portion 382 and/or adjacent to each lateral arm 386 to facilitate a break-away action of the lateral arms 386 upon impact of the broadhead.

Retaining clip 380 includes a plurality of lateral arms 386 which extend laterally from body 382 in front of each blade. Each lateral arm 386 defines a forward facing impact edge or surface which may be flat or tapered to a cutting edge. Lateral arms 386 each define a blade slot 385 to receive the forward portion of a respective blade 60. The rearward face of each impact arm 386 defines a surface with a length and width sloped at an angle which covers and abuts a blade forward edge when the broadhead is in the closed position.

Blade slots 385 are defined by the rearward face of the forward wall of the lateral arm, an inner side wall extending rearward and substantially parallel to a face of the blade, and the inner face of the outer end 387. In the illustrated embodiment, outer ends 387 are each curved rearward to receive and partially encircle a blade tip or corner and to partially extend along an inward blade edge. Optionally yet preferably, a retention tab 388 is formed adjacent the lateral entrance to the blade slot. The retention tab 388 and inner wall are spaced apart by a gap sized to receive the width of the blade.

Retaining clip 380 engages blades 60 in the closed position. The retaining clip may receive and engage the blades edges and tips by being twisted in a rotational action in a plane perpendicular to the broadhead axis. The retaining clip may be engaged with a snap-on movement during rotation, wherein the forward blade edges laterally enter the blade slots 385 sufficiently to allow retention tabs 388 to slide past the blade width. The retention tab may slightly flex outward during movement, and may then rebound to partially abut a blade face, thereby capturing the blade width between the retention tab and the inner wall.

Broadhead embodiments herein are typically used with a bow and arrow. For example, prior to use with a bow, the broadhead is mounted to an arrow shaft. A retaining clip such as can be used to engage and retain blades either prior to or after mounting the broadhead to an arrow shaft. For example, a retaining clip can be mounted during initial broadhead assembly for packaging, shipment and storage. Alternately, retaining clip can be mounted and engaged and/or replaced as the broadhead is initially mounted or mounted for reuse on an arrow shaft or as the broadhead is stored, with or without an arrow shaft.

As part of the preparation process, it is desirable to retain the blades in a closed position. Typically, the broadhead is initially manually moved to place the blades in the closed position or configuration. In the illustrated embodiments, hub 40 and blades 60 are advanced toward and adjacent to tip 24 and the rearward ends of blades 60 are rotated inward to the closed position. Separately, before or after placing the blades in the closed position, a retaining clip is advanced along the broadhead body from a rearward direction or a forward direction until it is adjacent a desired position relative to blades 60.

Figure 9:
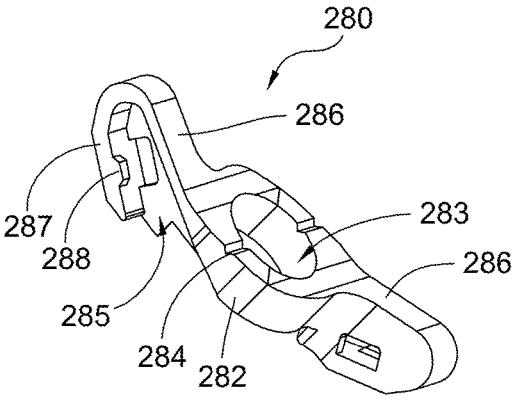
FIG. 9 is a perspective view of a retaining clip usable with the broadhead of FIG. 8.

Once a retaining clip is in position adjacent the blades, the retaining clip is rotated or twisted around the axis of the broadhead, with the entrance sides of the blade slots advanced toward outer sides of corresponding blades. The retaining clip is rotated until the blades enter the blade slots. The blades are then retained by the clip. For embodiments such as illustrated in FIGS. 1-7, in this position the lateral arm 86 is typically parallel to and adjacent a rearward side face of the blade. In this position, the retaining clip 80, and specifically end portions 88, retain rearward blade edges and prevent the blade from rotating outward to a deployed position. For embodiments such as illustrated in FIGS. 8-10, the lateral arm is typically parallel to and adjacent the forward edge of the blade. In this position, the lateral arms 286, 386 and specifically outer end portion 287, 387, retain the forward portion of the blade and prevent the blade from rotating outward to a deployed position.

Correspondingly in the embodiment of FIGS. 1-7, during the rotational engagement the rearward portion of each blade 60 passes over a corresponding spring portion 84, causing the spring portion to deflect slightly inward towards body 82. An end face of spring portion 84 is spaced from arm 86 by a gap sized to receive the thickness of the blade. As blade 60 enters blade slot 60 and the gap between spring portion 84 and arm 86, it will clear the end of spring portion 84, allowing spring portion 84 to slightly rebound outward. The end face of spring portion 84 may then partially abut a planar face of blade 60, holding the thickness of blade 60 between spring portion 84 and lateral arm 86. Consequently, blade 60 is retained in place by abutment along four sides.

In the embodiments of FIGS. 8-10, during the rotational engagement the forward portion of each blade 60 passes over a retention tab 288, 388 allowing the tab to deflect outward or rearward and then rebound slightly inward and forward. The retention tab may then partially abut a planar face of blade 60, holding the thickness of blade 60 between the retention tab and the inner wall. Consequently, the blade is abutted and retained in place along four sides.

Figure 11:
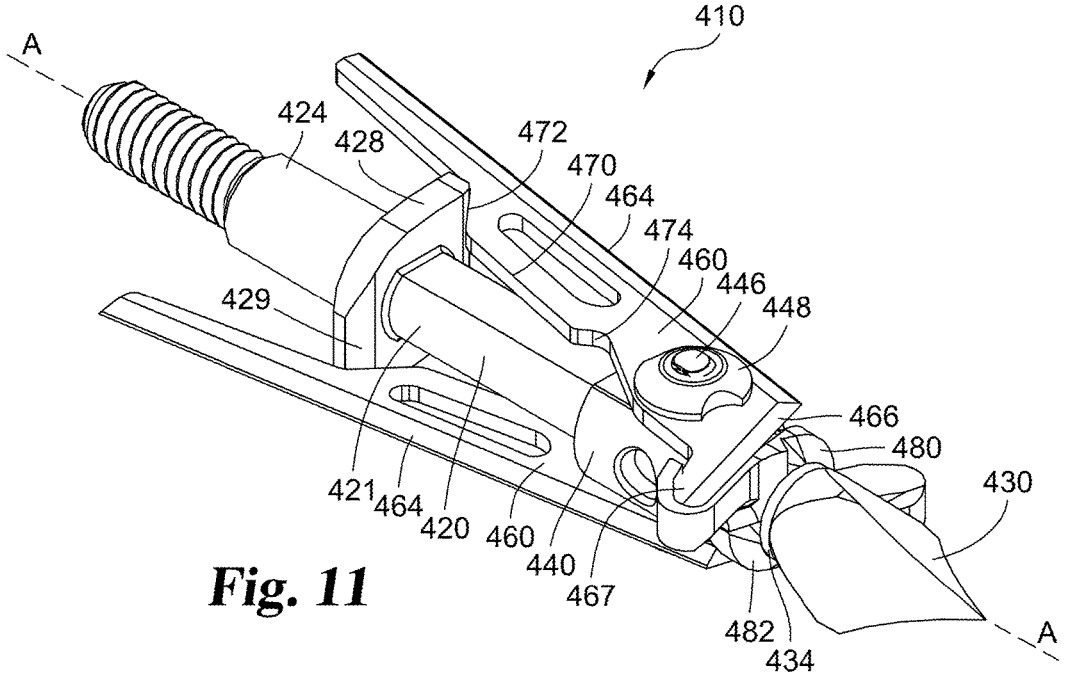
FIG. 11 is a side perspective view of a mechanical broadhead in a closed position according to an embodiment of the disclosure.
Figure 12:
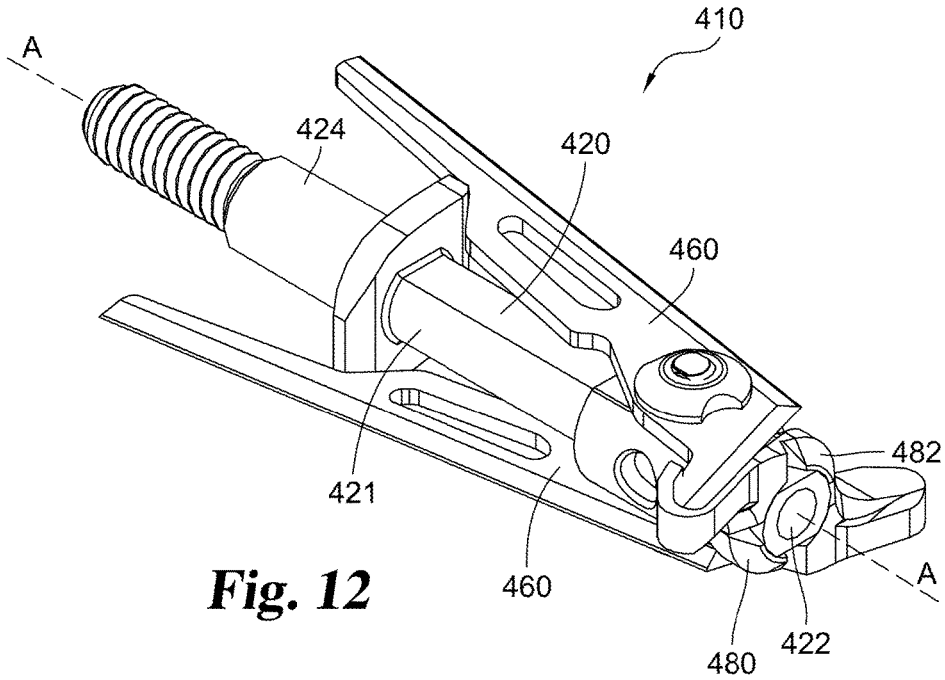
FIG. 12 is a side perspective view of the broadhead of FIG. 11 without the tip.
Figure 13:
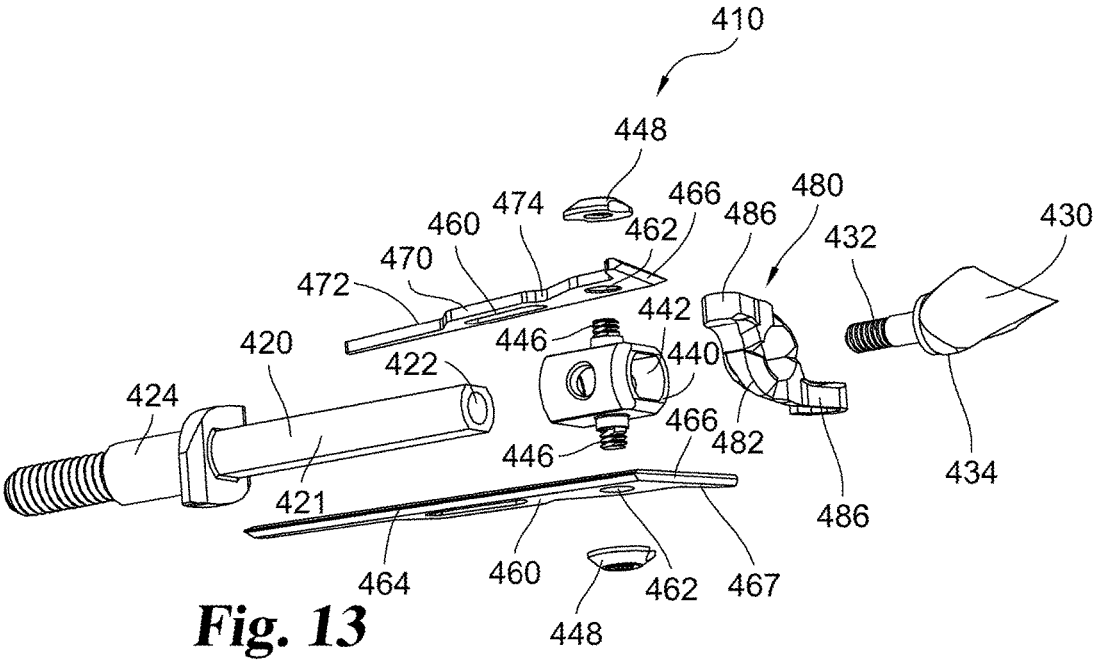
FIG. 13 is an exploded view of the broadhead of FIG. 11.

FIGS. 11-13 show views of an alternate embodiment of an example broadhead generally designated 410. The broadhead 410 is adapted for mounting to an open end of a hollow arrow shaft. The broadhead 40 includes a body 420. Body 420 includes a shaft portion 421. A pointed tip 430 is mountable to the forward end 422 of shaft 420. Body 420 includes a rearward end 424 configured to be connected to an arrow shaft. For example, the rearward end may include threads configured for pairing with threads inside of the arrow shaft. In other forms, broadhead 410 may be mounted to an arrow shaft in other ways, such as with mechanical fasteners, adhesives, resins, mounting on a ferrule or arrow shaft insert, or using other attachment techniques.

Tip 430 includes a pointed forward end and may include one or more substantially forward facing cutting edges. Typically, the tip 430 is tapered rearwardly and outwardly. A rearward portion 432 of tip 430 is mountable to body portion 420, for example rearward portion 432 can be threaded and received in a threaded bore defined by the forward face 422 of body 420. The broadhead shaft portion 421 may be formed with a circular or non-circular cross-section. For example in the illustrated embodiment the shaft portion 421 is roughly rectangular with a pair of opposing flat surfaces and a pair of opposing convexly curved surfaces.

In certain optional embodiments, a rearward portion of body 420 transitions into a shelf or ledge 428, extending radially outward from at least portions of the sides of the body 420. Certain edges of shelf or ledge 428 may form camming surfaces 429. A portion of body 420 extends rearward from shelf 428 to the rearward end 424. Body 420 can be integrally made as a single piece. Alternately, body 420 may be assembled from one or more pieces secured together.

In the illustrated embodiment, hub 440 is slidably mounted on shaft portion 421, typically between tip 430 and shelf 428. Hub 440 is operable to translate forward or rearward relative to the shaft portion 421 and along axis A. Hub 440 defines an interior passage 442 with a cross-section sized and shaped to approximately match the cross-section of body 422 and which inhibits rotation of hub 440 with respect to the shaft portion 421. In certain embodiments, axle screws 446 extend outward from hub 440. Axle screws 446 may be integrally formed with hub 440.

One or more cutting blades 460 are pivotally attached to the exterior of hub 440. As illustrated, the flat sides or faces of each blade define a plane which is parallel to yet offset or angled so the plane does not intersect the longitudinal axis of body 420. In the illustrated embodiment, a pair of blades 460 are pivotally mounted to hub 440. As illustrated, the planes of the two blades are arranged as mirror images and parallel to each other on opposing sides of the longitudinal axis of the shaft portion. The blades may extend to a cutting diameter in the open configuration, for example a cutting diameter of 1.5" or 2".

An axle screw 446 extends through a pivot axle opening 462 defined in each blade so that the axle screw acts as an axle for the blade. The blades are secured to the exterior of hub 440 via the lock nuts 448 while remaining operable to pivot. In the illustrated embodiment, the axle screws have a shaft with a smooth cylindrical axle portion with a thickness approximately matching the thickness of a blade, which transitions to an outer threaded end portion. Alternately, other connection methods or fasteners can be used to pivotally mount the blades to a hub.

Each blade 460 is roughly triangular in shape, and includes an outward cutting edge 464. Typically the outward cutting edge is the primary cutting edge and is sharpened to cut a target such as an animal. Each blade 460 further includes an inward edge. The inward edge includes a central camming portion 470. Rearward of portion 470 is a retention notch 472. Forward of portion 470 is a locking notch 474. Each blade further includes a leading forward edge 466 which extends to a leading tip or corner 467. As illustrated, forward edge 466 is angled to substantially diverge and be non-parallel relative to the longitudinal axis of broadhead body 420 from a rearward corner which forms an apex with cutting edge 464. From the apex with cutting edge 464, forward edge 466 is angled to extend across and forward to the corner or apex of tip 467.

Each blade 460 defines an axle hole or pivot hole 462 around which the blade may pivot. A forward blade portion is arranged forward of the pivot hole and a rearward portion is arranged rearward of the pivot hole, with an apex or corner adjacent the pivot hole. In the illustrated embodiment, the forward blade portion including forward edge 466 is arranged at an angle relative to the rearward portion with edge 464 which forms a bell crank arrangement around pivot hole 462 such that pivotal movement or retention of the forward blade portion can be used to control the location of a rearward blade portion, and vice-versa.

In FIGS. 11-13 blades 460 are illustrated offset from central axis A and in a right-handed configuration. More specifically, when viewed from a rear perspective such as from an archer's perspective during use, the rearward portions including cutting edges 464 of each blade are predominantly arranged counter-clockwise relative to the respective blade's pivot hole 462. The rearward or nock ends of many arrows shafts include vanes or fletchings which may be offset and/or helically mounted to impart a spinning motion to the arrow during flight. Commonly, the fletchings are arranged in what is referred to as a right-handed configuration, which imparts a clockwise rotation to the arrow from the archer's perspective. Alternately, the fletchings or vanes can be in a straight or left handed configuration.

In the present broadhead embodiment, the offset planes and mass distribution of the blades can impart a spinning force to the broadhead during flight. By arranging the blades 460 in a right-handed configuration to match the fletching configuration, the spinning force applied by the blades compliments the spin imparted by the fletching during flight. Additionally, upon impact, the right-handed configuration of the blades imparts a spinning force during cutting which compliments and continues the spin of the arrow in the same direction. Alternately, a left-handed blade configuration, such as illustrated in FIG. 1, can be used to match a left-handed vane fletching arrangement on an arrow shaft.

FIGS. 11-13 specifically illustrate an embodiment of a broadhead 410 in a closed configuration. In the closed position, hub 440 is at its forwardmost position, adjacent to tip 430. In the closed position, the length of blades 460 is close to parallel to the shaft portion. If present, the retention notch 472 of each blade abuts a forward face of shelf 428.

Figure 14:
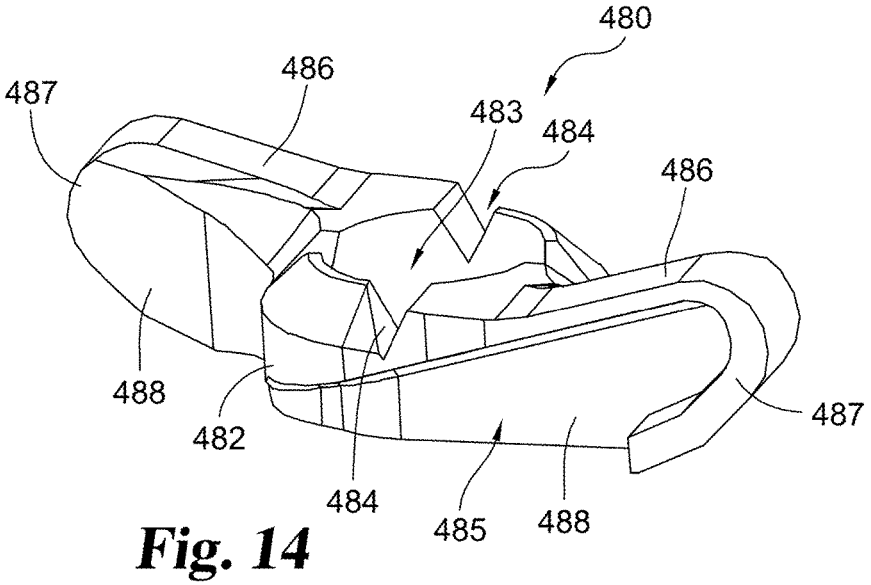
FIG. 14 is a perspective view of a retaining clip usable with the broadhead of FIG. 11.

In certain embodiments, a retaining clip 480 is arranged to engage forward portions of the blades, for example it can be placed forward of the hub and blades. Retaining clip 480 is shown in detail in FIG. 14. Retaining clip 480 includes a slider body or base portion 482 which defines an interior passage 483 with a cross-section sized and shaped to encircle and approximately match the cross-section of the forward end shaft portion 421. The cross-section of passage 483 allows rotation of retaining clip 480 with respect to the broadhead around longitudinal axis A. The rearward surface of slider body 482 may abut the forward surface of the hub 440. Optionally, break-away notches 484 may be defined in base portion 482 to facilitate a break-away action of the clip upon impact of broadhead 410.

Retaining clip 480 includes lateral arms 486 which extend laterally from body 482 in front of each blade 460. Each lateral arm is offset yet parallel to a geometric radius of body 482. Each lateral arm 486 defines a forward facing impact edge or surface. The forward facing impact edge may be a flat surface or may be tapered forward to form a sharpened edge. Lateral arms 486 each define a blade slot 485 configured to receive the forward edge 466 of a respective blade 460. The blade slot 485 may be angled in an outward and forward direction from body 482 to match the profile of blade edge 466 and tip 467. The rearward face of the forward portion of each impact arm 486 defines a rearward facing surface with a length and width sloped at an angle which covers and abuts a blade forward edge 466 when the broadhead is in the closed position and in the clip. The rearward face of the forward portion of the lateral arm may optionally define a slightly inward sloped surface and then a flat surface perpendicular to forward edge 466.

Each blade slot 485 is defined by the rearward face of the forward portion of the lateral arm 486, an inner side wall 488 extending rearward and substantially parallel to a face of the blade, and the inner face of an outer end 487. In the illustrated embodiment, outer ends 487 are each curved rearward to receive and encircle a blade tip or corner 467 and to then slightly extend rearward and inward along an inward edge portion.

Retaining clip 480 engages blades 460 in the closed position of broadhead 410 to inhibit rotation of the blades prior to launch and during flight. During assembly, the clip 480 is mounted to the broadhead body and blades while tip 430 is removed, as illustrated in FIG. 12. For example, the broadhead blades 460 and body 420 are placed in a closed position with the retention notches 472 of blades 460 abutting shelf 428. Then the body portion 482 of clip 480 is placed over the forward end 422 of the shaft portion 421 with the rearward face of clip 480 abutting a forward face of hub 440. In this position, the thickness of body portion 482 extends slightly forward of the forward end 422 of the shaft portion 421, creating a slight height difference. Retaining clip 480 is rotated so slots 485 receive and engage the blade forward portions to cover the forward edges and encircle the tips in a rotational action relative to axis A. Retaining clip 480 is rotated in a plane perpendicular to axis A.

Tip 430 is then mounted to the forward end 422 of the shaft portion 421 with the tip rearward portion 432 engaging a threaded bore in the shaft. Tip 430 includes a base portion 434 with a diameter slightly larger than the inner diameter of the clip passage section 483. As tip 430 is advanced rearward and tightened into its final position, base 434 presses the clip body 482 and consequently hub 440 slightly rearward. The rearward force and slight movement of hub 440 applies a rearward force against blades 460, which presses the blades against shelf 428. Shelf 428 creates a camming action which begins to urge blades 460 outward toward an open position. As the rearward portions of blades 460 are urged outward, the forward tip portions 467 are urged downward within blade slots 485, yet that movement is resisted and prevented by the clip corner portions 487. Consequently, the blades 460 are held in tension between the camming forces from the shelf and the resistance forces of the clip slots 485. This tension force holds the blades 460 in compression in preparation for use. The compression force also minimizes the risk of the blades making unintended movements or noise prior to an impact with a target. Optionally, the tip portion can be only partially tightened and/or loosened, to minimize forces on the blades during storage or transport.

Figure 15:
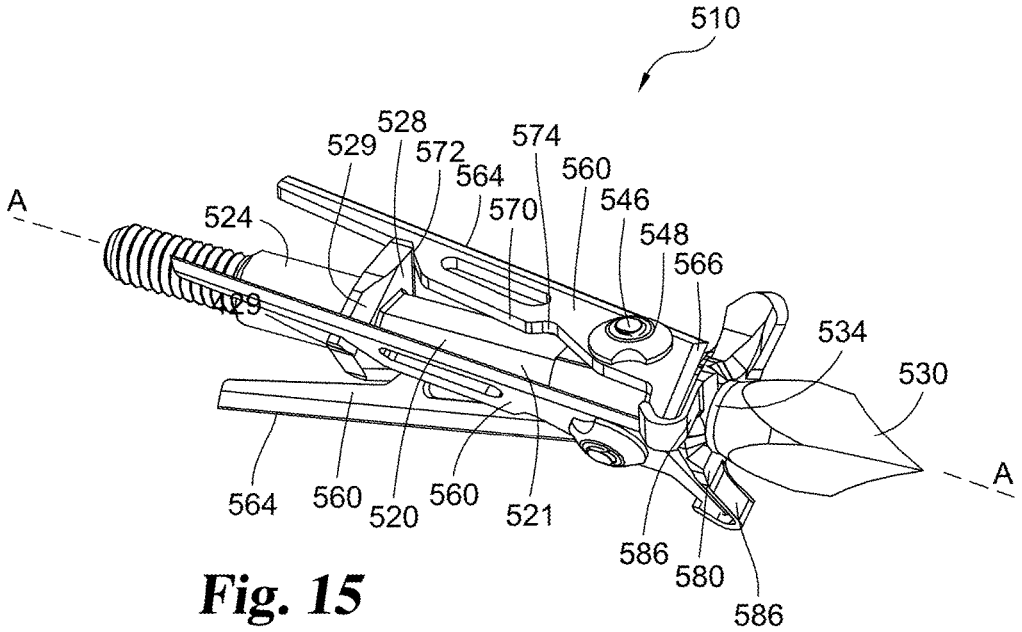
FIG. 15 is a side perspective view of a mechanical broadhead in a closed position according to an embodiment of the disclosure.
Figure 16:
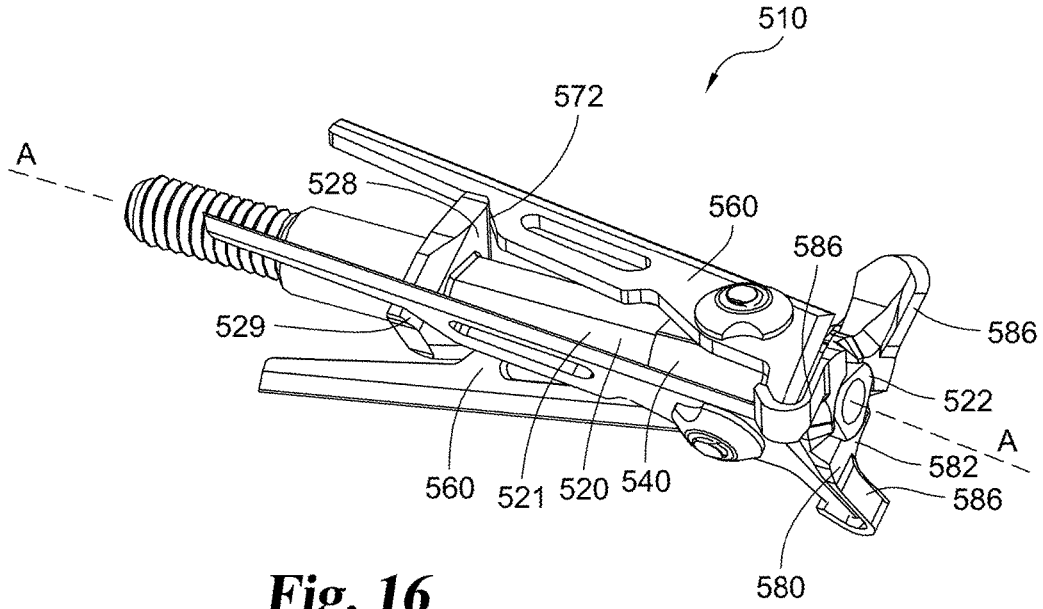
FIG. 16 is a side perspective view of the broadhead of FIG. 15 without the tip.
Figure 17:
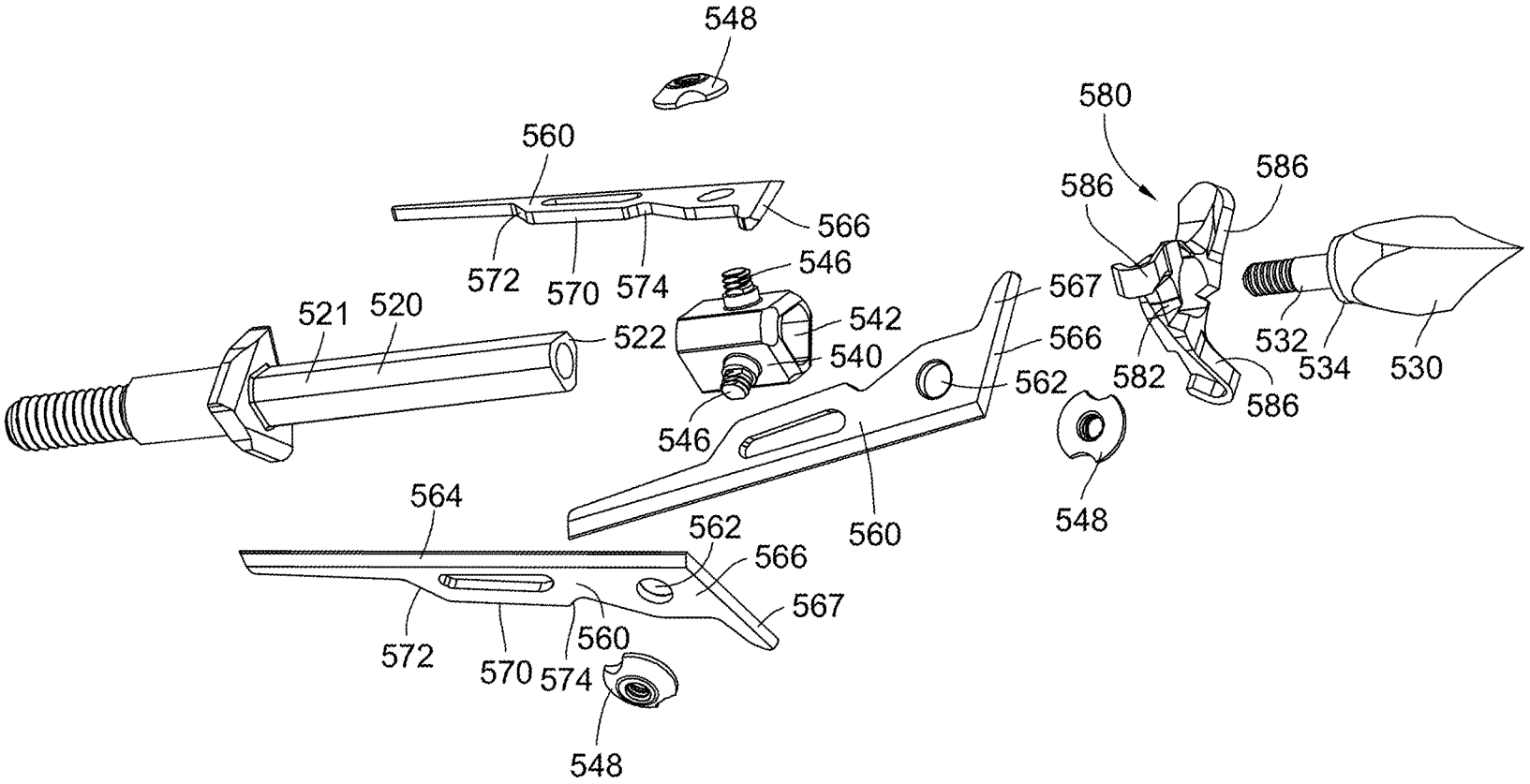
FIG. 17 is an exploded view of the broadhead of FIG. 15.

FIGS. 15-17 show views of an example three bladed broadhead generally designated 510. The broadhead 510 is adapted for mounting to an open end of a hollow arrow shaft. The broadhead 510 includes a body 520. Body 520 includes a shaft portion 521. A pointed tip 530 may be mounted to the forward end 522 of shaft 520. Body 520 includes a rearward end 524 configured to be connected to an arrow shaft. For example, the rearward end may include threads configured for pairing with threads inside of the arrow shaft. In other forms, broadhead 510 may be mounted to an arrow shaft in other ways, such as with mechanical fasteners, adhesives, resins, mounting on a ferrule or arrow shaft insert, or using other attachment techniques.

Tip 530 includes a pointed forward end and may include one or more substantially forward facing cutting edges. Typically, the pointed tip 530 is tapered rearwardly and outwardly. A rearward portion 532 of tip 530 is mountable to body portion 520, for example rearward portion 532 can be threaded and received in a threaded bore defined by the forward end 522 of body 520. The broadhead shaft portion 521 may be formed with a circular or non-circular cross-section, for example in the illustrated embodiment portions of the shaft portion 521 have a triangular cross-section with rounded corners.

In certain optional embodiments, a rearward portion of body 520 transitions into a shelf or ledge 528, extending radially outward from at least portions of the sides of the body 520. Certain edges of shelf or ledge 528 may form camming surfaces 529. A portion of body 520 extends rearward from shelf 528 to the rearward end 524. Body 520 can be integrally made as a single piece. Alternately, body 520 may be assembled from one or more pieces secured together.

In the illustrated embodiment, hub 540 is slidably mounted on shaft portion 521, typically between tip 530 and shelf 528. Hub 540 is operable to translate forward or rearward relative to the shaft portion 521 and along axis A. Hub 540 defines an interior passage 542 with a cross-section sized and shaped to approximately match the cross-section of shaft portion 521 and which inhibits rotation of hub 540. In certain embodiments, axle screws 546 extend outward from hub 540. Axle screws 546 may be integrally formed with hub 540.

One or more cutting blades 560 are pivotally attached to the exterior of hub 540. As illustrated, the flat sides or faces of each blade define a plane which is parallel to yet offset or angled so the plane does not intersect the longitudinal axis A of body 520. In the illustrated embodiment, three blades 560 are pivotally mounted to hub 540. As illustrated, the planes of the blades are equally spaced, for example at 120 degree offsets, around the hub and shaft. The blades may extend to a cutting diameter in the open configuration, for example a cutting diameter of 1.5" or 2".

An axle screw 546 extends through a pivot axle opening 562 defined in each blade so that the axle screw acts as an axle for the blade. The blades are secured to the exterior of hub 540 via the lock nuts 548 while remaining operable to pivot. In the illustrated embodiment, the axle screws have a shaft with a smooth cylindrical axle portion with a thickness approximately matching the thickness of a blade, which transitions to an outer threaded end portion. Alternately, other connection methods or fasteners can be used to pivotally mount the blades to a hub.

Each blade 560 is roughly triangular in shape, and includes an outward cutting edge 564. Typically the outward cutting edge is the primary cutting edge and is sharpened to cut a target such as an animal. Each blade 560 further includes an inward edge. The inward edge includes a central camming portion 570. Rearward of portion 570 is a retention notch 572. Forward of portion 570 is a locking notch 574. Each blade further includes a leading forward edge 566 which extends to a leading tip or corner 567. As illustrated, forward edge 566 is angled to substantially diverge and be non-parallel relative to the longitudinal axis of broadhead body 520 from a rearward corner which forms an apex with cutting edge 564. From the apex with cutting edge 564, forward edge 566 is angled to extend across and forward to the corner or apex of tip 567.

Each blade 560 defines an axle hole or pivot hole 562 around which the blade may pivot. A forward blade portion is arranged forward of the pivot hole and a rearward portion is arranged rearward of the pivot hole, with an apex or corner adjacent the pivot hole. In the illustrated embodiment, the forward blade portion including forward edge 566 is arranged at an angle to the rearward portion including cutting edge 564 which forms a bell crank arrangement around pivot hole 562 such that pivotal movement or retention of the forward blade portion can be used to control the location of a rearward blade portion, and vice-versa.

In FIGS. 15-17 blades 560 are illustrated offset from central axis A and in a right-handed configuration. More specifically, when viewed from a rear perspective such as from an archer's perspective during use, the rearward portions with cutting edges 564 of each blade are predominantly arranged counter-clockwise relative to the respective blade's pivot hole 562. In the present embodiment, the offset planes and mass distribution of the blades can impart a spinning force to the broadhead during flight. By arranging the blades 560 in a right-handed configuration to match the fletching configuration, the spinning force applied by the blades compliments the spin imparted by the fletching. Additionally, upon impact, the right-handed configuration of the blades imparts a spinning force during cutting which continues the spin of the arrow. Alternately, a left-handed blade configuration can be used to match a left-handed fletching arrangement on an arrow shaft.

FIGS. 15-17 specifically illustrate broadhead 510 in a closed configuration. In the closed position, hub 540 is at its forwardmost position, adjacent to tip 530. In the closed position, the length of blades 560 is close to parallel to the shaft portion. If present, the retention notch 572 of each blade abuts a forward face of shelf 528.

Figure 18A:
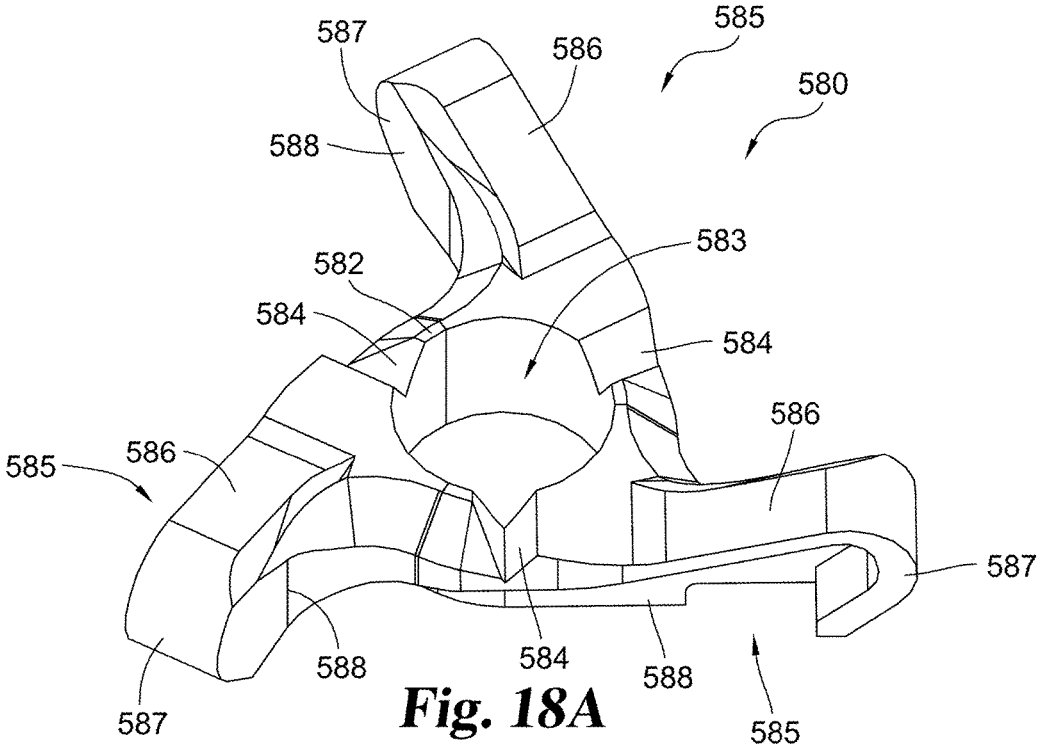
FIG. 18A is an upper perspective view of a retaining clip usable with the broadhead of FIG. 15.
Figure 18B:
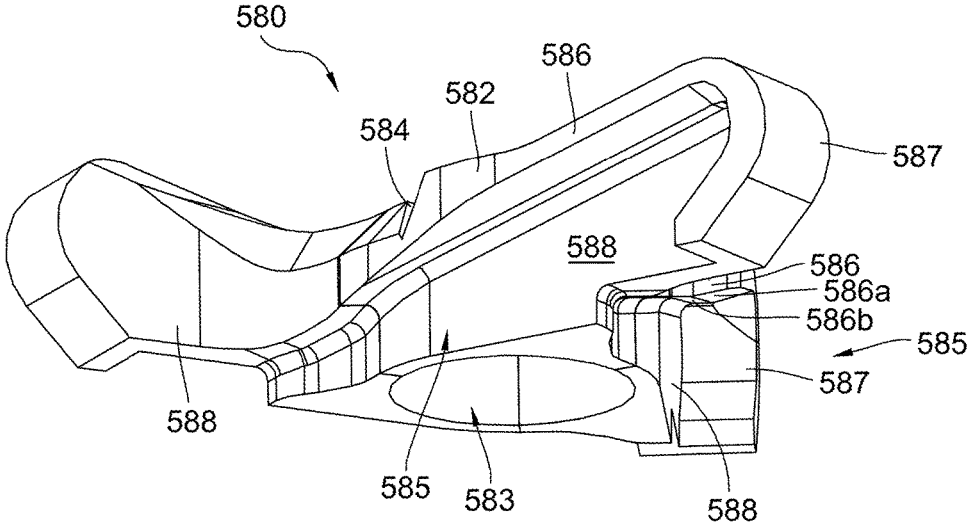
FIG. 18B is a lower perspective view of a retaining clip usable with the broadhead of FIG. 15.

In certain embodiments, a retaining clip 580 is arranged to engage forward portions of the blades, for example it can be placed forward of the hub and blades. Retaining clip 580 is shown in detail in FIGS. 18A & 18B. Retaining clip 580 includes a slider body or base portion 582 which defines an interior passage 583 with a cross-section sized and shaped to encircle the forward end 522 of shaft portion 521. The cross-section of passage 583 allows rotation of retaining clip 580 with respect to the broadhead around longitudinal axis A. The rearward surface of slider body 582 may abut the forward surface of the hub 540. Optionally, break-away notches 584 may be defined in base portion 582 to facilitate a break-away action of the clip upon impact of broadhead 510.

Retaining clip 580 includes three lateral arms 586 which extend laterally from body 582 in front of each blade 560. Each lateral arm is offset yet parallel to a geometric radius of body 582. Each lateral arm 586 defines a forward facing impact edge or surface. The forward facing impact edge may be flat surface or may be tapered forward to form a sharpened cutting edge. Lateral arms 586 each define a blade slot 585 configured to receive the forward edge 566 of a respective blade 560. The blade slot 585 may be angled in an outward and forward direction from body 582 to match the profile of blade edge 566 and tip 567. The rearward face of the forward portion of each impact arm 586 defines a rearward facing surface with a length and width sloped at an angle which covers and abuts a blade forward edge 566 when the broadhead is in the closed position and in the clip. The rearward face of the forward portion of the lateral arm may optionally define a slightly inward sloped surface 586*a* and then a flat surface 586*b* perpendicular to forward edge 566.

Each blade slot 585 is defined by the rearward face of the forward portion of the lateral arm 586, an inner side wall 588 extending rearward and substantially parallel to a face of the blade, and the inner face of an outer end 587. In the illustrated embodiment, outer ends 587 are each curved rearward to receive and encircle a blade tip or corner 567 and to then slightly extend rearward and inward along an inward edge portion.

Retaining clip 580 engages blades 560 in the closed position of broadhead 510 to inhibit rotation of the blades prior to launch and during flight. During assembly, the clip 580 is mounted to the broadhead body and blades while tip 530 is removed, as illustrated in FIG. 16. For example, the broadhead blades 560 and body 520 are placed in a closed position with the retention notches 572 of blades 560 abutting shelf 528. Then the body portion 582 of clip 580 is placed over the forward end 522 of the shaft portion 521 with the rearward face of clip 580 abutting a forward face of hub 540. In this position, the thickness of body portion 582 initially extends slightly forward of the forward end 522 of the shaft portion 521, creating a slight height difference. Retaining clip 580 is rotated so that slots 585 receive and engage the blade forward portions to cover the forward edges and encircle the tips. Retaining clip 580 is rotated in a plane perpendicular to axis A.

Tip 530 is then mounted to the forward end of the shaft portion 521. Tip 530 includes a base portion 534 with a diameter slightly larger than the diameter of the clip passage 583. As tip 530 is advanced rearward and tightened into place, base 534 presses the clip body 582 and consequently hub 540 slightly rearward. The rearward force and slight movement of hub 540 applies a rearward force against blades 560, which presses the blades against shelf 528. Shelf 528 creates a camming action which begins to urge blades 560 outward toward an open position. As the rearward portions of blades 560 are urged outward, the forward tip portions 567 are urged downward within clip slots 585, yet that movement is resisted and prevented by the clip corner portions 587. Consequently, the blades 560 are held in tension between the camming forces from the shelf and the resistance forces of the clip slots 585. This tension force holds the blades 560 in compression in preparation for use. The compression force also minimizes the risk of the blades making unintended movements or noise prior to an impact with a target.

In further alternate embodiments, the lateral arms of the retaining clip may be slightly flexible, with a lip or retaining flange formed adjacent the outer side of the entrance to each blade slot. As the blade is rotationally introduced into the blade slot, the lateral arms slightly flex sideways and/or with the end portion bent slight outward to accommodate the blade edge. The arm and end portion then rebound to extend across the cutting edge of the blade, placing the lip or flange past the cutting edge and alongside the blade side opposite the arm, thus assisting to retain the blade in the blade slot. Curved portions, sloped areas or angles can be formed on the retaining clip body, lateral arms, end portions and/or spring portions to assist in urging or wedging the respective portions to move sufficiently to allow clearance as the retaining clip is rotated to engage the blades with the blade slots.

In still further alternate embodiments, blades may be pivotally mounted to a broadhead body without including a sliding hub. In some embodiments, forward ends of the blades are pivotally mounted to the body and rearward ends are forced to move outward to a deployed position upon impact. In alternate arrangements, rearward end of the blades are pivotally mounted to a broadhead body, and the forward ends rotate outward and rearward to a deployed position upon impact. Alternately, the blades may incorporate a sliding mechanism without a sliding hub in moving from a closed configuration to an open configuration, for example with the blades sliding through slots defined in a broadhead body.

When used with a bow and arrow, broadheads according to the disclosed embodiments may be fired at a target. During storage, prior to launch, and in flight prior to impact, the broadhead preferably remains in the closed position, preferably having aerodynamic properties. For example, an arrow equipped with a broadhead in the closed position may approximate the flight characteristics of a field point.

In certain embodiments, as illustrated with a front view in FIG. 3, for example the tip 24 and forward edges 66 of the blades define impact surfaces when the broadhead strikes a target. The tip 24 initially impacts a target and begins to penetrate directly or less preferably with a glancing blow. As the tip enters the target, the target surface moves along and around the tip and then impacts the surfaces of the leading edges 66 of the respective blades. The contact of the target surface with the leading edges 66 creates resistance and applies rearward force to the leading edges. The target surface may also apply rearward force to forward portions of hub 40 and lock screws 48. This initial impact causes an initial rotation of the blades, for example the blade in the foreground of FIG. 1 rotates counterclockwise, which causes retention notch 72 to disengage from shelf 28 by rotating slightly radially outward over camming surface 29. This rotation may also break or dislodge retaining clip 80, for example breaking off end portions 88 or lateral arms 86.

In alternate embodiments, for example as illustrated in FIGS. 8, 11 and 15, the forward edges of the blades are covered. Instead, the tip and forward surfaces of the retaining clip and lateral arms define impact surfaces when the broadhead strikes a target. The initial impact is transmitted to forward portions of the blades through the retaining clip and causes a rotation of the blades which may break or dislodge the retaining clip.

With reference to broadhead 10 as illustrative, as the broadhead continues to travel forward, the target surface continues to apply rearward force to the hub and blade assembly. This causes the blades to continue to rotate while also causing the blades 60 and hub 40 to begin traveling rearward as an assembly relative to the shaft portion. As hub 40 begins to translate rearward, the camming portion 70 of each blade is slidably pushed against the respective camming surface 29, assisting, via a camming or wedging force, the cutting edges 64 to radially rotate and expand outward. Each camming surface 29 may have an upper profile which is rounded or slanted to assist in forcing the camming portion 70 outward as the blades slide rearward.

Due to the mounting points on common hub 40, each blade is maintained at the same rearward/forward position with the other blades and accordingly the blades are balanced and synchronized in their rotation and movement. With the balanced assembly, the blades will rotate and open/deploy at the same rate even if the impact force is applied unevenly, for example due to a glancing impact between the broadhead and the target.

As the blades and hub 40 reach their rearwardmost position, the locking notches 74 of each blade engage a lower portion of the profile of the respective camming surfaces 29. The lower profile portions include a step or locking edge with a face which is substantially parallel to the axis of body 20, so that once locking notches 74 slide rearward past the upper portion of the camming surfaces, a locking edge engages each locking notch to prevent inward rotation, locking each blade in the deployed, fully expanded position. Expanded blades of the broadhead provide a larger cutting diameter and may increase hemorrhaging and bleeding when hunting. Increased bleed-out may provide a faster and more humane kill.

Once a broadhead with a retaining clip has been used, if any portions of the clip remain, the remainder can be removed and replaced with a new retaining clip. The new retaining clip can then be rotationally engaged to the broadhead blades to retain the broadhead in the closed position for reuse and/or storage.

The bodies, tips, blades and hubs of the present embodiments can be made from metal materials for strength and durability, for example, iron, steel, stainless steel, aluminum or titanium. In some embodiments, different portions are made from different materials For example, tip 430 or 530 may be made of machined or cast steel while a corresponding broadhead body 420 or 520 is made from machined or cast aluminum. Alternately, other conventional materials having appropriate strength, durability and weight characteristics such as certain composite, plastic or glass materials may be used. Optionally, certain components may include openings or grooves to reduce the amount of material used, correspondingly reducing the broadhead's mass and weight.

Retaining clips 80, 180, 280, 380, 480 and 580 and other retaining clip embodiments herein may be made from various materials, for example from plastic, polycarbonate, a semi-crystalline polyamide, a thermoplastic elastomer, acrylic, a resin material, a glass-filled nylon material or metal. In certain embodiments, the retaining clip materials are chosen for high stiffness and rigidity with sufficient strength to retain the blades during flight, yet with properties which are sufficiently brittle, frangible or flexible upon impact to facilitate blade disengagement and the break-away action of the arms or end portions when desired.

In certain embodiments, the retaining clips may be made from a transparent material, such as transparent polycarbonate. A transparent material may allow the user to see the blades to ensure they are properly positioned within the retaining clip and/or to confirm that the retaining clip is fully in place. Alternately the retaining clips can be made in various solid or translucent colors as desired.

While the embodiments have been illustrated and described in detail in the drawings and foregoing description, the same is to be considered as illustrative and not restrictive in character, it being understood that only the preferred embodiments have been shown and described and that all changes and modifications that come with the spirit of the disclosure are desired to be protected.

What is claimed is:

1. A broadhead arrowhead, comprising:

a broadhead body adapted to attach to an arrow shaft, the broadhead body defining a longitudinal axis;

a plurality of blades pivotally mounted on the broadhead body with each blade operable between a closed position and an open position; and, a retaining clip arranged on the broadhead body and rotatable around the longitudinal axis, the retaining clip having at least one laterally extending arm defining a blade slot engaging a blade to retain the blade in a closed position and wherein said at least one laterally extending arm engages a forward blade portion.

2. The broadhead arrowhead of claim 1, wherein the retaining clip has a plurality of laterally extending arms with each arm defining a blade slot engaging a blade to retain each blade in a closed position.

3. The broadhead arrowhead of claim 2, wherein portions of the retaining clip are designed to break away from the broadhead body upon impact.

4. The broadhead arrowhead of claim 3, comprising breakaway notches defined on the retaining clip to form defined breakage points.

5. The broadhead arrowhead of claim 1, comprising a blade assembly including a hub slidably mounted on a shaft portion of the broadhead body, and wherein the plurality of blades are pivotally mounted to the hub.

6. The broadhead arrowhead of claim 1, wherein the retaining clip is transparent.

7. A broadhead arrowhead, comprising:

a broadhead body adapted to attach to an arrow shaft and defining a longitudinal axis;

a plurality of blades pivotally mounted on the broadhead body, each blade operable between a closed position and an open position, wherein each blade is roughly triangular in shape and defines a forward blade portion including a forward edge arranged forward of a blade pivot point and a rearward blade portion including an outer cutting edge arranged rearward of the blade pivot point, wherein the forward portion and the rearward portion form a bell crank arrangement around the pivot point;

a retaining clip arranged on the broadhead body, the retaining clip having a body and a plurality of lateral arms each defining a blade slot, wherein each lateral arm defines a blade slot and wherein the retaining clip is rotatable around the longitudinal axis to introduce each blade into a blade slot, wherein the blade slot engages the blade to retain the blade in the closed position and wherein each lateral arm engages a forward blade portion.

8. The broadhead arrowhead of claim 7, Wherein each forward blade portion extends to a blade tip, and wherein the retaining clip encircles the tip.

9. The broadhead arrowhead of claim 7, comprising a pointed tip mountable to the broadhead body, wherein a base of the pointed tip abuts the retaining clip.

10. The broadhead arrowhead of claim 9, wherein the blades are retained in place under a compressive three when the pointed tip is mounted to the broadhead body.

11. The broadhead arrowhead of claim 7, wherein portions of the retaining clip are designed to break away upon impact.

12. The broadhead arrowhead of claim 11, comprising breakaway notches defined in the retaining clip to form defined breakage points.

13. A method of securing a broadhead arrowhead in a closed position, comprising:

providing a broadhead body adapted to attach to an arrow shaft, the broadhead body defining a longitudinal axis and having a plurality of blades pivotally mounted on the broadhead body and operable between a closed position and an open position;

placing the blades in the closed position;

placing a retaining clip over a portion of the broadhead body, the retaining clip having a plurality of lateral arms, with each lateral arm defining a blade slot;

rotating the retaining clip around the longitudinal axis so that a forward end of each blade is received in a respective blade slot; and, retaining a portion of each blade in a respective blade slot.

14. The method of claim 13, comprising applying force to the retaining clip to place the blades in compression while the blades are retained in the retaining clip.

15. The method of claim 13, comprising mounting a pointed tip to the broadhead body after placing the retaining clip over a portion of the broadhead body.

16. The method of claim 15, comprising tightening the pointed tip to the broadhead body to apply a rearward force against the retaining clip to place the blades in compression.

17. The method of claim 15, wherein the blades are pivotally mounted to a sliding hub on the broadhead body, and comprising applying a rearward force to the hub as the pointed tip is mounted to the broadhead body.

18. The method of claim 13, comprising retaining a tip portion of each blade in each blade slot.

* * * * *